United States Patent [19]

Jackson et al.

[11] Patent Number: 5,013,366

[45] Date of Patent: May 7, 1991

[54] CLEANING PROCESS USING PHASE SHIFTING OF DENSE PHASE GASES

[75] Inventors: David P. Jackson, Saugus; Orval F. Buck, Santa Monica, both of Calif.

[73] Assignee: Hughes Aircraft Company, Los Angeles, Calif.

[21] Appl. No.: 287,207

[22] Filed: Dec. 7, 1988

[51] Int. Cl.[5] ..... B08B 3/08; B08B 3/12

[52] U.S. Cl. ..... 134/1; 134/2; 134/10; 134/38; 134/40; 204/157.42; 204/157.5; 204/157.62; 204/157.21; 210/774

[58] Field of Search ..... 134/1, 2, 10, 38, 40; 210/774, 96.1; 204/157.42, 157.5, 157.62, 157.21

[56] References Cited

U.S. PATENT DOCUMENTS

| | | | |
|---|---|---|---|
| 4,061,566 | 12/1977 | Modell | 502/22 |
| 4,147,624 | 4/1979 | Modell | 502/22 |
| 4,379,724 | 4/1983 | Kashiwagi | 134/1 |
| 4,576,837 | 3/1986 | Tarawcon et al. | 427/255.4 |
| 4,718,974 | 1/1988 | Minaee | 134/1 |
| 4,854,337 | 8/1989 | Bunkenburg et al. | 134/1 |

FOREIGN PATENT DOCUMENTS 60-192333 9/1985 Japan .

8402291 6/1984 PCT Int'l Appl. .

*Primary Examiner*—Olik Chaudhuri
*Assistant Examiner*—George R. Fourson
*Attorney, Agent, or Firm*—Mary E. Lachman; W. K. Denson-Low

[57] ABSTRACT

A process for removing two or more contaminants from a substrate in a single process. The substrate to be cleaned is contacted with a dense phase gas at or above the critical pressure thereof. The phase of the dense phase gas is then shifted between the liquid state and the supercritical state by varying the temperature of the dense fluid in a series of steps between temperatures above and below the critical temperature of the dense fluid. After completion of each step in the temperature change, the temperature is maintained for a predetermined period of time in order to allow contact with the substrate and contaminants and removal of the contaminants. At each step in the temperature change, the dense phase gas possesses different cohesive energy density or solubility properties. Thus, this phase shifting of the dense fluid provides removal of a variety of contaminants from the substrate without the necessity of utilizing different solvents. In alternative embodiments, ultraviolet radiation, ultrasonic energy, or reactive dense phase gas or additives may additionally be used.

36 Claims, 5 Drawing Sheets

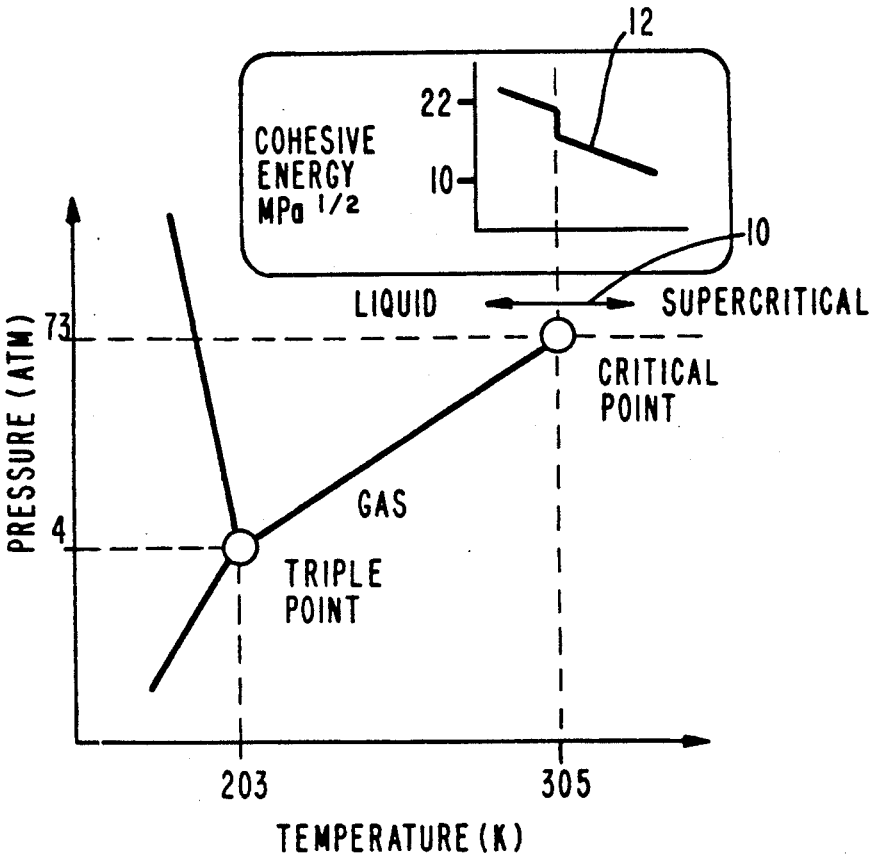
Fig. 1.
Fig. 2.
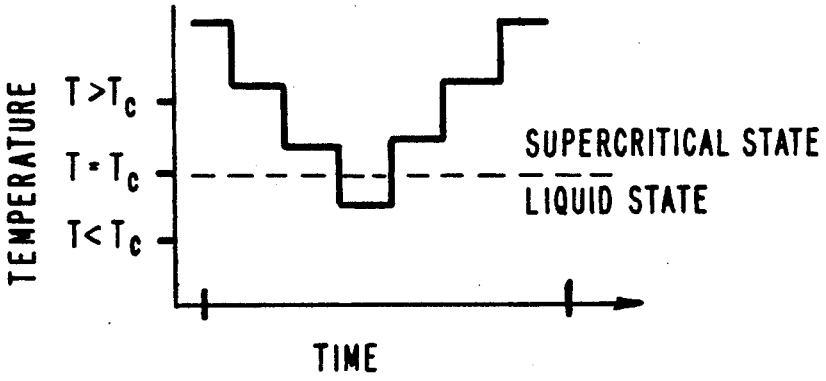

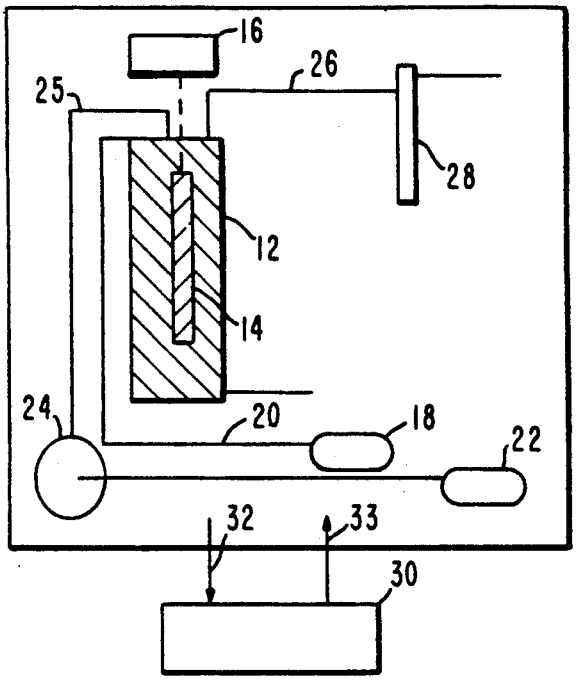
Fig. 4.
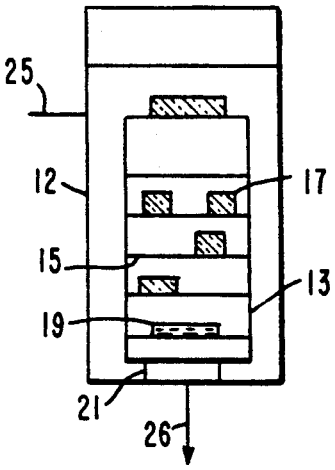
Fig. 5a.
Fig. 5b.
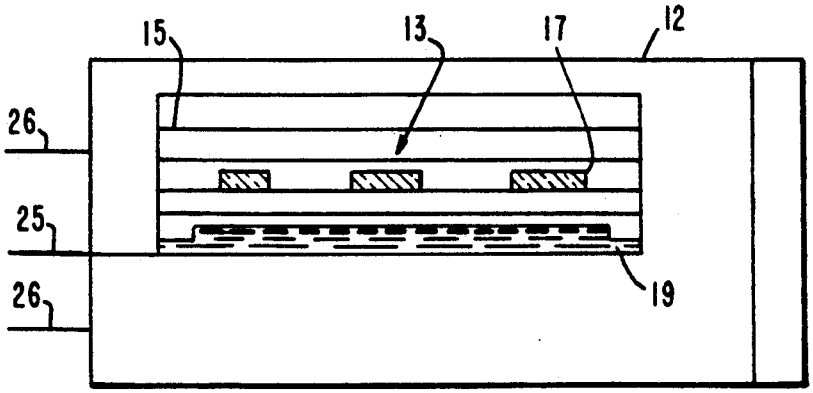

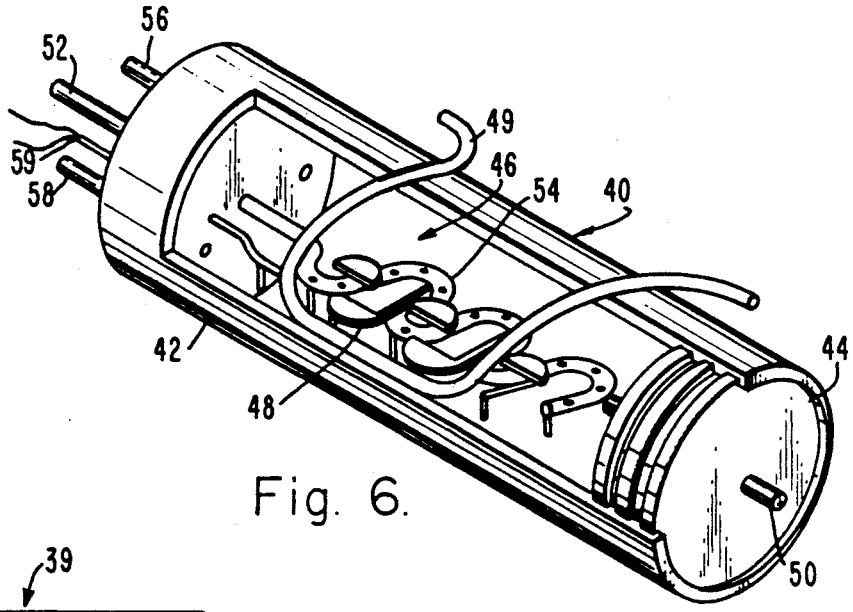
Fig. 6.
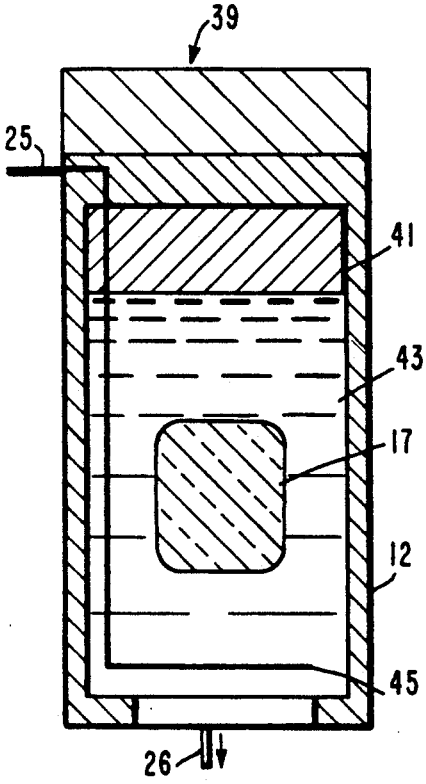
Fig. 7
Fig. 8.
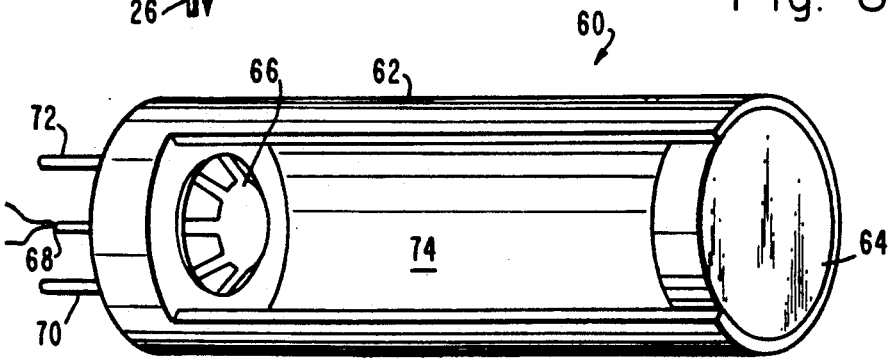

CLEANING PROCESS USING PHASE SHIFTING OF DENSE PHASE GASES

BACKGROUND OF THE INVENTION

1. Field of the Invention

The present invention relates generally to the use of dense phase gases for cleaning substrates. More particularly, the present invention relates to a process utilizing phase shifting of dense phase gases or gas mixtures in order to enhance the cleaning of a wide variety of substrates, including complex materials and hardware.

2. Description of Related Art

Conventional solvent-aided cleaning processes are currently being re-evaluated due to problems with air pollution and ozone depletion. In addition, recent environmental legislation mandates that many of the organic solvents used in these processes be banned or their use severely limited. The use of dense phase gases or gas mixtures for cleaning a wide variety of materials has been under investigation as an alternative to the above-mentioned solvent based cleaning processes. A dense phase gas is a gas compressed to either supercritical or subcritical conditions to achieve liquid-like densities. These dense phase gases or gas mixtures are also referred to as dense fluids. Unlike organic solvents, such as n hexane or 1,1,1 trichloroethane, dense fluids exhibit unique physical and chemical properties such as low surface tension, low viscosity, and variable solute carrying capacity.

The solvent properties of compressed gases is well known. In the late 1800's, Hannay and Hogarth found that inorganic salts could be dissolved in supercritical ethanol and ether (J. B. Hannay and H. Hogarth, *J.Proc.Roy.Soc.* (London), 29, p. 324, 1897). By the early 1900's, Buchner discovered that the solubility of organics such as naphthalene and phenols in supercritical carbon dioxide increased with pressure (E. A. Buchner, *Z.Physik.Chem.*, 54, p. 665, 1906). Within forty years Francis had established a large solubility database for liquefied carbon dioxide which showed that many organic compounds were completely miscible (A. W. Francis. *J.Phys.Chem.*, 58, p. 1099, 1954).

In the 1960's there was much research and use of dense phase gases in the area of chromatography. Supercritical fluids (SCF) were used as the mobile phase in separating non volatile chemicals (S. R. Springston and M. Novotny, "Kinetic Optimization of Capillary Supercritical Chromatography using Carbon Dioxide as the Mobile Phase", *CHROMATOGRAPHIA*, Vol. 14, No. 12, p. 679, December 1981). Today the environmental risks and costs associated with conventional solvent aided separation processes require industry to develop safer and more cost-effective alternatives. The volume of current literature on solvent-aided separation processes using dense carbon dioxide as a solvent is evidence of the extent of industrial research and development in the field. Documented industrial applications utilizing dense fluids include extraction of oil from soybeans (J. P. Friedrich and G. R. List and A. J. Heakin, "Petroleum Free Extracts of Oil from Soybeans", *JAOCS*, Vol. 59, No. 7, July 1982), decaffination of coffee (C. Grimmett, *Chem.Ind.*, Vol. 6, p. 228, 1981), extraction of pyridines from coal (T. G. Squires, et al, "Super-critical Solvents. Carbon Dioxide Extraction of Retained Pyridine from Pyridine Extracts of Coal", *FUEL*, Vol. 61, November 1982), extraction of flavorants from hops (R. Vollbrecht, "Extraction of Hops with Supercritical Carbon Dioxide", *Chemistry and Industry*, 19 June 1982), and regenerating absorbents (activated carbon) (M. Modell, "Process for Regenerating Absorbents with Supercritical Fluids", U.S. Pat. No. 4,124,528, 7 November 1978).

Electro-optical devices, lasers and spacecraft assemblies are fabricated from many different types of materials having various internal and external geometrical structures which are generally contaminated with more than one type of contamination. These highly complex and delicate assemblies can be classified together as "complex hardware". Conventional cleaning techniques for removing contamination from complex hardware require cleaning at each stage of assembly. In addition to the above-mentioned problems with conventional solvent aided cleaning techniques, there is also a problem of recontamination of the complex hardware at any stage during the assembly process. Such recontamination reguires disassembly, cleaning, and reassembly. Accordingly, there is a present need to provide alternative cleaning processes which are suitable for use in removing more than one type of contamination from complex hardware in a single process.

SUMMARY OF THE INVENTION

In accordance with the present invention, a cleaning process is provided which is capable of removing different types of contamination from a substrate in a single process. The process is especially well-suited for removing contaminants such as oils, grease, flux residues and particulates from complex hardware.

The present invention is based in a process wherein the substrate to be cleaned is contacted with a dense phase gas at a pressure equal to or above the critical pressure of the dense phase gas. The phase of the dense phase gas is then shifted between the liquid state and the supercritical state by varying the temperature of the dense fluid in a series of steps between temperatures above and below the critical temperature of the dense fluid. After completion of each step in the temperature change, the temperature is maintained for a predetermined period of time in order to allow contact with the substrate and contaminants and removal of the contaminants. At each step in the temperature change, the dense phase gas possesses different cohesive energy density or solubility properties. Thus, this phase of contaminants from the substrate without the necessity of utilizing different solvents.

In an alternative embodiment of the present invention, the cleaning or decontamination process is further enhanced by exposing the dense phase gas to ultraviolet (UV) radiation during the cleaning process. The UV radiation excites certain dense phase gas molecules to increase their contaminant removal capability.

In another alternative embodiment of the present invention ultrasonic energy is applied during the cleaning process. The ultrasonic energy agitates the dense phase gas and substrate surface to provide enhanced contamination removal.

In yet another alternative embodiment of the present invention, a dense phase gas which reacts with the contaminants is used to enhance contaminant removal.

The above-discussed and many other features and attendant advantages of the present invention will become better understood by reference to the following detailed description when considered in conjunction with the accompanying drawings.

BRIEF DESCRIPTION OF THE DRAWINGS

In the accompanying drawings:

FIG. 1 presents a phase diagram for a preferred exemplary dense phase gas in accordance with the present invention, and a corresponding curve of cohesive energy versus temperature.

FIG. 2 is a diagram illustrating an exemplary temperature cycling sequence used to produce the phase shifting in accordance with the present invention.

FIG. 4 is a diagram of an exemplary system for use in accordance with the present invention.

FIG. 5*a* and FIG. 5*b* are schematic diagrams of exemplary racks used to load and hold the substrates to be cleaned in accordance with the present process.

FIG. 6 is a partial sectional view of a preferred exemplary cleaning vessel for use in accordance with a first embodiment of the present invention.

FIG. 7 is an alternate exemplary cleaning vessel in accordance with a second embodiment of the present invention using multi phase dense fluid cleaning.

FIG. 8 is an alternative exemplary cleaning vessel in accordance with a third embodiment of the present invention for use in applying sonic energy during cleaning.

DESCRIPTION OF THE PREFERRED EMBODIMENTS

Figure 3:
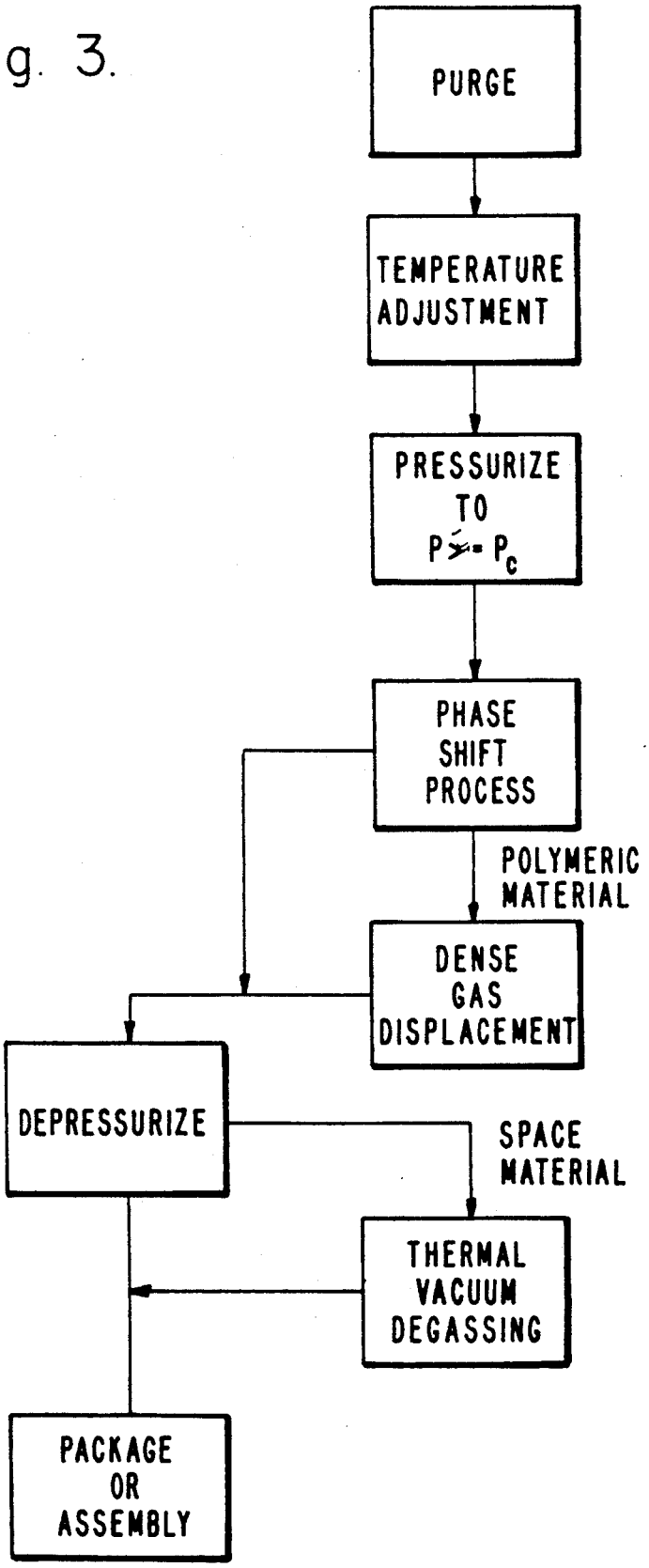
FIG. 3 is a flowchart setting forth the steps in an exemplary process in accordance with the present invention.

The dense phase fluids which may be used in accordance with the present invention include any of the known gases which may be converted to supercritical fluids or liquefied at temperatures and pressures which will not degrade the physical or chemical properties of the substrate being cleaned. These gases typically include, but are not limited to: (1) hydrocarbons, such as methane, ethane, propane, butane, pentane, hexane, ethylene, and propylene; (2) halogenated hydrocarbons such as tetrafluoromethane, chlorodifluoromethane, sulfur hexafluoride, and perfluoropropane; (3) inorganics such as carbon dioxide, ammonia, helium, krypton, argon, and nitrous oxide; and (4) mixtures thereof. The term "dense phase gas" as used herein is intended to include mixtures of such dense phase gases. The dense phase gas selected to remove a particular contaminant is chosen to have a solubility chemistry which is similar to that of the targeted contaminant. For example, if hydrogen bonding makes a significant contribution to the internal cohesive energy content, or stability, of a contaminant, the chosen dense phase gas must possess at least moderate hydrogen bonding ability in order for solvation to occur. In some cases, a mixture of two or more dense phase cases may be formulated in order to have the desired solvent properties, as discussed hereinbelow with regard to an alternative embodiment of this invention. The selected dense phase gas must also be compatible with the substrate being cleaned, and preferably has a low cost and high health and safety ratings.

Carbon dioxide is a preferred dense phase gas for use in practicing the present invention since it is inexpensive and non toxic. The critical temperature of carbon dioxide is 305° Kelvin (32° C.; and the critical pressure is 72.9 atmospheres. The phase diagram for carbon dioxide is set forth in FIG. 1. At pressures above the critical point, the phase of the carbon dioxide can be shifted between the liquid phase and supercritical fluid phase by varying the temperature above or below the critical temperature of 305 Kelvin (K).

In accordance with the present invention, a single dense phase gas or gas mixture is phase shifted in order to provide a spectrum of solvents which are capable of removing a variety of contaminants. "Phase shifting" is used herein to mean a shift between the liquid state and the supercritical state as represented by the bold arrow 10 in FIG. 1. The phase shifting is accomplished by varying the temperature of the dense phase gas while maintaining the pressure at a relatively constant level which is at or above the critical pressure of the dense phase gas. The pressure is predetermined by computation to provide the necessary solvent spectrum during temperature cycling, as described in greater detail hereinbelow. The temperature of the dense phase gas is varied in a series of steps between a temperature above the critical temperature of the dense phase gas and a temperature below this critical temperature. As indicated in curve 12 in FIG. 1, this temperature change produces a change in the cohesive energy density or solubility parameter of the dense phase gas. As shown in FIG. 1, increasing the temperature of dense phase carbon dioxide from 300K to 320K changes the gas solvent cohesive energy content from approximately 24 megapascals$^{\frac{1}{2}}$(MPa$^{\frac{1}{2}}$) to 12 MPa$^{\frac{1}{2}}$. This change in cohesive energy content produces a change in the solvent properties of the dense phase gas. Thus, in accordance with the present invention, the solvent properties of the dense phase gas may be controlled in order to produce a variation in solvent properties such that the dense phase gas is capable of dissolving or removing a variety of contaminants of differing chemical composition in a single treatment process. A spectrum of distinct solvents is provided from a single dense phase gas or gas mixture. The cohesive energy of the dense phase gas is matched to that of the contaminant in order to remove the contaminant. Optionally, the cohesive energy of the dense phase gas is also matched to that of the substrate in order to produce substrate swelling, as discussed in further detail below.

The phase shifting is accomplished in accordance with the present invention by a step-wise change in temperature, as indicated by way of example in FIG. 2, where T is the process or operating temperature and $T_c$ is the critical temperature. In FIG. 2, at a constant pressure greater than the critical pressure, the temperature is incrementally decreased to a point below $T_c$ and is then incrementally increased to the starting temperature above $T_c$. After each step in the temperature change, the temperature is held constant for a predetermined period of time during which the substrate and contaminants are exposed to the dense phase gas and contaminants are removed. As discussed with regard to FIG. 1, at each step in the temperature change of FIG. 2, the dense phase gas has different solvent properties, i.e., a different solvent exists at each step. Consequently, a variety of contaminants can be removed by this solvent spectrum. The stepwise change from $T>T_c$ to $T<T_c$ and back to $T>T_c$ is referred to herein as a "temperature cycle." The starting point for the temperature cycling maybe either above or below the critical temperature. In accordance with the present process, the temperature cycle may he repeated several times, if required, in order to produce increased levels of contaminant removal. Each successive cycle removes more contaminants. For example after one cycle, 30 percent of the contaminants may be removed; after the second cycle, 60 percent of the contaminants may be removed; and after the third cycle, 75 percent of the contaminants may be removed. The phase shift cycle of the present invention also improves contaminant removal by enhancing floatation and inter-phase transfer of contaminants, thermally-aided separation of contaminants, and micro-bubble formation.

The values of operating temperature and pressure used in practicing the process of the present invention may be calculated as follows. First, the cohesive energy value of the contaminants is computed or a solubility value is obtained from published data. Next, based upon the critical temperature and pressure data of the selected dense phase gas or gas mixture, and using gas solvent equations, such as those of Giddings, Hildebrand, and others, a set of pressure/temperature values is computed. Then, a set of curves of solubility parameter versus temperature is generated for various pressures of the dense phase gas. From these curves a phase shift temperature range at a chosen pressure can be determined which brackets the cohesive energies (or solubility parameters) of the contaminants. Due to the complexity of these calculations and analyses, they are best accomplished by means of a computer and associated software.

The number of times the phase shift cycle is repeated, the amount of change in temperature for each step in the cycle, and the residence time at each step are all dependent upon the extent of contaminant removal which is required, and can readily be determined experimentally as follows. The substrate is subjected to one or more phase shift cycles in accordance with the present invention, and then the substrate is examined to determine the extent of cleaning which has been accomplished. The substrate may be examined by visual or microscopic means or by testing, such as according to the American Society for Testing and Materials, Standard E595 "Total Mass Loss (TML) and Collected Volatile Condensable Material (CVCM).' Depending on the results obtained, selected process parameters may be varied and their effect on the extent of contaminant removal determined. From this data, the optimum process parameters for the particular cleaning requirements may be determined. Alternatively, the exhausted gas solvent may be analyzed to determine the amount of contaminants contained therein. Gravimetric, spectroscopic, or chromatographic analysis may be used for this purpose. The extent of contaminant removal is then correlated with the various process parameters to determine the optimum conditions to be used. Typical process parameters which have been found to be useful include, but are not limited to, the following: variation of the temperature above the critical temperature by about 5 to 100K; variation of the temperature below the critical temperature by about 5 to 25K; step changes in temperature of about 5 to 10K; and residence time at each step of about 5 to 30 minutes.

A flowchart showing the steps in the cleaning process of a first embodiment of the present invention is presented in FIG. 3. The process is carried out in a cleaning vessel which contains the substrate to be cleaned. Various exemplary cleaning vessels will be described in detail below. As shown in FIG. 3, the cleaning vessel is initially purged with an inert gas or the gas or gas mixture to be used in the cleaning process. The temperature in the pressure vessel is then adjusted to a temperature either below the critical temperature (subcritical) for the gas or gas mixture or above or equal to the critical temperature (supercritical) for the gas. The cleaning vessel is next pressurized to a pressure which is greater than or equal to the critical pressure for the gas or gas mixture. At this point, the gas is in the form of a dense fluid. The phase of this dense fluid is then shifted between liquid and supercritical states, as previously described, by varying the temperature over a predetermined range above and below the critical point, as determined by the type and amount of contaminants to be removed. Control of temperature, pressure and gas flow rates is best accomplished under computer control using known methods.

The process of controlled temperature variation to achieve phase shifting has been discussed with regard to FIG. 2. Phase shifting back and forth between the liquid and supercritical states can be performed as many times as required. After phase shifting has been completed, the cleaning vessel is then depressurized and the treated substrate is removed and packaged or treated further.

When cleaning substrates which will be used in the space environment, the dense fluids may themselves become contaminants when subjected to the space environment. Therefore, substrates to be used in space are subjected to an additional thermal vacuum degassing step after the high pressure dense fluid cleaning process. This step is shown in FIG. 3 wherein the cleaning vessel is depressurized to a vacuum of approximately 1 Torr (millimeter of mercury) and a temperature of approximately 395K (250° F.) is applied for a predetermined (i.e., precalculated) period of time in order to completely degas the hardware and remove any residua+-gas from the hardware. The depressurization of the cleaning vessel after the cleaning process has been completed is carried out at a rate determined to be safe for the physical characteristics, such as tensile strength, of the substrate.

For certain types of substrates such as polymeric materials, internal dense fluid volumes are high upon completion of the cleaning process. Accordingly, during depressurization, the internal interstitial gas molar volume changes drastically. The gas effusion rate from the polymer is limited depending upon a number of factors, such as temperature, gas chemistry, molar volume, and polymer chemistry. In order to ease internal stresses caused by gas expansion, it is preferred that the fluid environment in the cleaning vessel be changed through dense gas displacement prior to depressurization, maintaining relatively constant molar volume. The displacement gas is chosen to have 1 diffusion rate which is higher than that of the dense phase gas. This step of dense gas displacement is shown in FIG. 3 as an optional step when polymeric materials are being cleaned. For example, if a non polar dense phase cleaning fluid, such as carbon dioxide, has been used to clean a non polar polymer, such as butyl rubber, then a polar fluid, such as nitrous oxide, should be used to displace the non polar dense fluid prior to depressurization since the polar fluid will generally diffuse more readily from the polymer pores. Alternatively, dense phase helium may be used to displace the dense phase gas cleaning fluid since helium generally diffuses rapidly from polymers upon depressurization.

The present invention may be used to clean a wide variety of substrates formed of a variety of materials.

The process is especially well adapted for cleaning complex hardware without requiring disassembly. Some exemplary cleaning applications include: defluxing of soldered connectors, cables and populated circuit boards; removal of photoresists from substrates; decontamination of cleaning aids such as cotton or foam-tipped applicators, wipers, gloves, etc; degreasing of complex hardware; and decontamination of electro optical, laser and spacecraft complex hardware including pumps, transformers, rivets, insulation, housings, linear bearings, optical bench assemblies, heat pipes, switches, gaskets, and active metal castings. Contaminant materials which may be removed from substrates in accordance with the present invention include, but are not limited to, oil, grease, lubricants, solder flux residues, photoresist, particulates comprising inorganic or organic materials, adhesive residues, plasticizers, unreacted monomers, dyes, or dielectric fluids. Typical substrates from which contaminants may be removed by the present process include, but are not limited to, substrates formed of metal, rubber, plastic, cotton, cellulose, ceramics, and other organic or inorganic compounds. The substrates may have simple or complex configurations and may include interstitial spaces which are difficult to clean by other known methods. In addition, the substrate may be in the form of particulate matter or other finely divided material. The present invention has application to gross cleaning processes such as degreasing, removal of tape residues and functional fluid removal, and is also especially well adapted for precision cleaning of complex hardware to high levels of cleanliness.

In accordance with an alternative embodiment of the present invention, a mixture of dense phase gases is formulated to have specific solvent properties. For example, it is known that dense phase carbon dioxide does not hydrogen bond and hence is a poor solvent for hydrogen bonding compounds, such as abietic acid, which is a common constituent in solder fluxes. We have found by calculation that the addition of 10 to 25 percent anhydrous ammonia, which is a hydrogen-bonding compound, to dry liquid carbon dioxide modifies the solvent chemistry of the latter to provide for hydrogen bonding without changing the total cohesion energy of the dense fluid system significantly. The anhydrous ammonia gas is blended with the carbon dioxide gas and compressed to liquid-state densities, namely the subcritical or supercritical state. These dense fluid blends of $CO_2$ and $NH_3$ are useful for removing polar compounds, such as plasticizers from various substrates. In addition to possessing hydrogen-bonding ability, the carbon dioxide/ammonia dense fluid blend can dissolve ionic compounds, and is useful for removing residual ionic flux residues from electronic hardware and for regenerating activated carbon and ion exchange resins. This particular dense phase solvent blend has the added advantage that it is environmentally acceptable and can be discharged into the atmosphere. Similar blends may be made using other non-hydrogen-bonding dense fluids, such as blends of ammonia and nitrous oxide or ammonia and xenon.

An exemplary system for carrying out the process of the present invention is shown diagrammatically in FIG. 4. The system includes a high pressure cleaning chamber or vessel 12. The substrate is placed in the chamber 12 on a loading rack as shown in FIG. 5*a* or FIG. 5*b*. The temperature within the chamber 12 is controlled by an internal heater assembly 14 which is powered by power unit 16 which is used in combination with a cooling system (not shown) surrounding the cleaning vessel. Coolant is introduced from a coolant reservoir 18 through coolant line 20 into a coolant jacket or other suitable structure (not shown) surrounding the high pressure vessel 12. The dense fluid used in the cleaning process is fed from a gas reservoir 22 into the chamber 12 through pressure pump 24 and inlet line 25. The system may be operated for batch type cleaning or continuous cleaning. For batch type cleaning, the chamber 12 is pressurized to the desired level and the temperature of the dense phase gas is adjusted to the starting point for the phase shifting sequence, which is either above or below the critical temperature of the dense phase gas. The vessel is repeatedly pressurized and depressurized from the original pressure starting point to a pressure below the critical pressure. Sequentially, the temperature of the vessel is adjusted up or down, depending on the types of contaminants, and the pressurization/depressurization steps are carried out. The resulting dense fluid containing contaminants is removed from the chamber 12 through exhaust line 26. The cleaning vessel may be repressurized with dense phase gas and depressurized as many times as required at each temperature change. The exhaust line may be connected to a separator 28 which removes the entrained contaminants from the exhaust gas thereby allowing recycling of the dense phase gas. Phase shifting by temperature cycling is continued and the above-described depressurization and repressurizations are performed as required to achieve the desired level of cleanliness of the substrate.

For continuous cleaning processes, the dense fluid is introduced into chamber 12 by pump 24 at the same rate that contaminated gas is removed through line 26 in order to maintain the pressure in chamber 12 at or above the critical pressure. This type of process provides continual removal of contaminated gas while the phase of the dense fluid within chamber 12 is being shifted back and forth between liquid and supercritical states through temperature cycling.

The operation of the exemplary system shown schematically in FIG. 4 is controlled by a computer 30 which utilizes menu-driven advanced process development and control (APDC) software. The analog input, such as temperature and pressure of the chamber 12, is received by the computer 30 as represented by arrow 32. The computer provides digital output, as represented by arrow 33 to control the various valves, internal heating and cooling systems in order to maintain the desired pressure and temperature within the chamber 12. The various programs for the computer will vary depending upon the chemical composition and geometric configuration of the particular substrate being cleaned, the contaminant(s) being removed, the particular dense fluid cleaning gas or gas mixture, and the cleaning times needed to produce the required end-product cleanliness. Normal cleaning times are on the order of four hours or less.

Referring to FIGS. 3 and 4, an exemplary cleaning process involves initially placing the hardware into the cleaning vessel, chamber 12. The chamber 12 is closed and purged with clean, dry inert gas or the cleaning gas from reservoir 22. The temperature of the chamber 12 is then adjusted utilizing the internal heating element 14 and coolant from reservoir 18 to which is provided externally through a jacketing system, in order to provide a temperature either above or below the critical temperature for the cleaning gas or gas mixtures. The chamber 12 is then pressurized utilizing pump 24 to a pressure equal to or above the critical pressure for the particular dense phase gas cleaning fluid. This critical pressure is generally between about 20 atmospheres (300 pounds per square inch or 20.6 kilograms per square centimeter) and 102 atmospheres (1500 pounds per square inch or 105.4 kilograms per square centimeter). The processing pressure is preferably between 1 and 272 atmospheres (15 and 4000 pounds per square inch or 1.03 and 281.04 kilograms per square centimeter) above the critical pressure, depending on the breadth of solvent spectrum and associated phase shifting range which are required.

Once the pressure in chamber 12 reaches the desired point above the critical pressure, the pump 24 may be continually operated and exhaust line 26 opened to provide continuous flow of dense fluid through the chamber 12 while maintaining constant pressure. Alternatively, the exhaust line 26 may be opened after a sufficient amount of time at a constant pressure drop to remove contaminants, in order to provide for batch processing. For example, a pressure drop of 272 atmospheres (4,000 psi) to 102 atmospheres (1500 psi) over a 20-minute cleaning period can be achieved.

Phase shifting of the dense fluid between liquid and supercritical states is carried out during the cleaning process. This phase shifting is achieved by controlled ramping of the temperature of the chamber 12 between temperatures above the critical temperature of the dense fluid and temperatures below the critical temperature of the dense fluid while maintaining the pressure at or above the critical pressure for the dense fluid. When carbon dioxide is used as the dense fluid the temperature of chamber 12 is cycled above and below 305K (32° centigrade).

FIG. 5 shows two exemplary racks which may be used to load and hold the substrates to be cleaned in accordance with the present invention. FIG. 5*a* shows a vertical configuration, while FIG. 5*b* shows a horizontal configuration. In FIGS. 5*a* and 5*b*, the following elements are the same as those shown in FIG. 4: chamber or pressure vessel 12, gas inlet line 25, and gas outlet line(s) 26. A rack 13 with shelved 15 is provided to hold the substrates 17 to be treated in accordance with the present process. The rack 13 and shelves 15 are made of a material which is chemically comparable with the dense fluids used and sufficiently strong to withstand the pressures necessary to carry out the present process. Preferred materials for the rack and shelves are stainless steel or teflon. The shelves 15 are constructed with perforations or may be mesh in order to insure the unobstructed flow of the dense fluid and heat transfer around the substrates. The rack 13 may have any convenient shape, such as cylindrical or rectangular, and is configured to be compatible with the particular pressure vessel used. The vertical configuration of FIG. 5*a* is useful with a pressure vessel of the type shown in FIG. 6 or 7 herein, whereas the horizontal configuration of FIG. 5*b* is useful with a pressure vessel of the type shown in FIG. 8 herein. As shown in FIG. 5*a*, legs or "stand-offs" 21 are provided in order to elevate the rack above the sparger carrying the dense phase gas. As indicated in FIG. 5*b*, the rack i- held on stand-offs (not shown) so that it is located in the upper half of the chamber in order to prevent obstruction of fluid flow. Optionally, in both of the configurations of FIGS. 5*a* and 5*b*, an additive reservoir 19 may be used in order to provide a means of modifying the dense phase gas by addition of a selected material, such as methanol or hydrogen peroxide. The reservoir 19 comprises a shallow rectangular or cylindrical tank. The modifier is placed in the reservoir 19 when the substrate is loaded into the chamber 12. The modifier may be a free-standing liquid or it may be contained in a sponge like absorbent material to provide more controlled release. Vapors of the modifier are released from the liquid into the remainder of the chamber 12 during operation of the system. The modifier is chosen to enhance or change certain chemical properties of the dense phase gas. For example, the addition of anhydrous ammonia to xenon provides a mixture that exhibits hydrogen bonding chemistry, which xenon alone does not. Similarly, the modifier may be used to provide oxidizing capability or reducing capability in the dense phase gas, using liquid modifiers such as ethyl alcohol, water, acid, base, or peroxide.

An exemplary high pressure cleaning vessel for use in practicing a first embodiment of the present process is shown at 40 FIG. 6. The vessel or container 40 is suitable for use as the high pressure cleaning vessel shown at 12 in the system depicted in FIG. 4. The high pressure cleaning vessel 40 included a cylindrical outer shell 42 which is closed at one end with a removable enclosure 44. The shell 42 and enclosure 44 are made from conventional materials which are chemically compatible with the dense fluids used and sufficiently strong to withstand the pressures necessary to carry out the process, such as stainless steel or aluminum. The removable enclosure 44 is provided .o that materials can be easily placed into and removed from the cleaning zone 46 within outer shell 42.

An internal heating element 48 is provided for temperature control in combination with an external cooling jacket 59 surrounding the shell 42. Temperature measurements to provide analog input into the computer for temperature control are provided by thermocouple 50. The gas solvent is fed into the cleaning zone 46 through inlet 52 which is connected to sparger 54. Removal of gas or dense fluid from the cleaning zone 46 is accomplished through exhaust ports 56 and 58.

The cleaning vessel 40 is connected into the system shown in FIG. 4 by connecting inlet 52 to inlet line 25, connecting heating element 48 to power source 16 using power leads 49, and connecting exhaust outlets 56 and 58 to the outlet line 26. The thermocouple 50 is connected to the computer 30.

In accordance with a second embodiment of the present invention, the contaminated substrate to be cleaned is suspended in a liquid suspension medium, such as deionized water, while it is subjected to the phase shifting of the dense phase gas as previously described. FIG. 7 shows an exemplary cleaning vessel which may be used to practice this embodiment of the present invention. The system shown in FIG. 7 is operated in the same manner as the system shown in FIG. 6 with the exceptions noted below. In FIG. 7, the following elements are the same as those described in previous figures: chamber or cleaning vessel 12, substrate 17, gas inlet line 25, and gas exhaust line 26. Within the chamber 12, there is an inner container 41, which is formed of a chemically resistant and pressure resistant material, such as stainless steel. The container 41 holds the liquid 43, in which the substrate 17 is suspended by being placed on a rack (not shown). A gas sparger 45 is provided for introducing the dense phase gas through the inlet line 25 into the lower portion of the container 41 and into the liquid 43. The phase shifting process is performed as previously described herein, and a multiphase cleaning system is produced. For example, if deionized water is used as the liquid suspension medium and carbon dioxide is used as the dense phase gas at a temperature greater than 305K and a pressure greater than 70 atmospheres, the following multiple phases result: (a) supercritical carbon dioxide, which removes organic contaminants; (b) deionized water, which removes inorganic contaminants; and (c) carbonic acid formed in situ, which removes inorganic ionic contaminants. In addition, during the depressurization step as previously described herein, the gas-saturated water produces expanding bubbles within the interstices of the substrate as well as on the external surfaces of the substrate. These bubbles aid in dislodging particulate contaminants and in "floating" the contaminants away from the substrate. The wet supercritical carbon dioxide containing the contaminants passes by interphase mass transfer from inner container 41 to chamber 12, from which it is removed through exhaust line 26.

After the substrate 17 has been cleaned, it is rinsed with clean hot deionized water to remove residual contaminants, and is then vacuum dried in an oven at 350K for 2 to 4 hours and packaged. Optionally, the substrate may be first dried with alcohol prior to oven drying.

Other dense phase gases which are suitable for use in this second embodiment of the present invention include, but are not limited to, xenon and nitrous oxide. In addition, the liquid suspension medium may alternatively contain additives, such as surfactants or ozone, which enhance the cleaning process. This embodiment of the present invention is particularly well suited for precision cleaning of wipers, gloves, cotton-tipped wooden applicators, and fabrics.

In a third embodiment of the present invention, the cleaning action of the dense fluid during phase shifting from the liquid to supercritical states may be enhanced by applying ultrasonic energy to the cleaning zone. A suitable high-pressure cleaning vessel and sonifier are shown at 60 in FIG. 8. The sonifier 60 includes a cylindrical container 62 having removable enclosure 64 at one end and ultrasonic transducer 66 at the other end. The transducer 66 is connected to a suitable power source by way of power leads 68. Such transducers are commercially available, for example from Delta Sonics of Los Angeles, California. Gas solvent feed line 70 is provided for introduction of the dense fluid solvent into the cleaning zone 74. Exhaust line 72 is provided for removal of contaminated dense fluid.

The sonifier 60 is operated in the same manner as the cleaning vessel shown in FIG. 6 except that a sparger is not used to introduce the dense fluid into the cleaning vessel and the temperature control of the sonification chamber 74 is provided externally as opposed to the cleaning vessel shown in FIG. 6 which utilizes an internal heating element. The frequency of ionic energy applied to the dense fluid during phase shifting in accordance with the present invention may be within the range of about 20 and 80 kilohertz. The frequency may be held constant or, preferably, may be shifted back and forth over the range of 20 to 80 kilohertz. The use of ultrasonic energy (sonification) increases cleaning power by aiding in dissolving and/or suspending bulky contaminants, such as waxes, monomers and oils, in the dedse fluid. Furthermore, operation of the sonic cleaner with high frequency sonic bursts agitates the dense phase gas and the substrate to promote the breaking of bonds between the contaminants and the substrate being cleaned. Use of sonification in combination with phase shifting has the added advantage that the sonification tends to keep the chamber walls clean and assists in removal of extracted contaminants.

In accordance with a fourth embodiment of the present invention, enhancement of the cleaning action of the dense fluid may be provided by exposing the fluid to high energy radiation. The radiation excites certain dense phase gas molecules to increase their contaminant-removal capability. Such gases include, but are not limited to carbon dioxide and oxygen. In addition, radiation within the range of 185 to 300 nm promotes the cleavage of carbon to-carbon bonds. Thus, organic contaminants are photo decomposed to water, carbon dioxide, and nitrogen. These decomposition products are then removed by the dense phase gas.

Figure 9A:
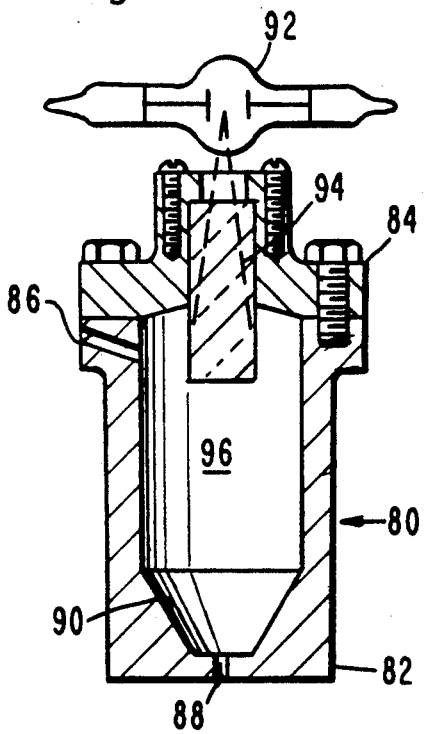
FIGS. 9*a* and 9*b* show an alternate exemplary cleaning vessel for use in applying radiation to the dense phase gas during the cleaning process of fourth and fifth embodiments of the present invention.
Figure 9B:
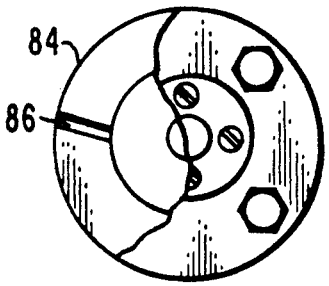

An exemplary cleaning vessel for carrying out such radiation-enhanced cleaning is shown at 80 in FIG. 9. The cleaning vessel 80 includes a container 82 which has a removable container cover 84, gas solvent feed port 86 which has an angled bore to provide for enhanced mixing in the chamber, and solvent exhaust port 88. The interior surface 90 preferably includes a radiation-reflecting liner. The preferred high energy radiation is ultraviolet (UV) radiation. The radiation is generated from a conventional mercury arc lamp 92, generally in the range between 180 and 350 nanometers. Xenon flash lamps are also suitable. Operation of the lamp may be either high energy burst pulsed or continuous. A high pressure guartz window 94, which extends deep into the chamber to achieve a light piping effect, is provided in the container cover 84 through which radiation is directed into the cleaning chamber 96. The cleaning vessel 80 is operated in the same manner as the cleaning vessels shown in FIGS. 6 and 8. Temperature control within the cleaning chamber 96 is provided by an external heating element and cooling jacket (not shown).

The cleaning vessels shown in FIGS. 6–9 are exemplary only and other possible cleaning vessel configurations may be used in order to carry out the process of the present invention. For example, cleaning vessels may be used wherein both sonification and ultraviolet radiation features are incorporated into the vessel. Furthermore, a wide variety of external and internal heating and cooling elements may be utilized in order to provide the necessary temperature control to accomplish phase shifting of the dense fluid between the liquid and supercritical fluid states.

The cleaning vessel shown in FIG. 6 is especially cleaning zone 46. The internally located heating element 48 in combination with an externally mounted cooling jacket or chamber makes it possible to create a temperature gradient within the cleaning chamber 46 when the flow rate and pressure of dense fluid is constant. Such a thermal gradient in which the temperature of the dense fluid decreases moving from the center toward the container walls, provides thermal diffusion of certain contaminants away from the substrate which is usually located centrally within the chamber. This thermal gradient also provides "solvent zones", that is a range of distinct solvents favoring certain contaminants or contaminant groups, which enhances he contaminant removal process.

In accordance with a fifth embodiment of the present invention, the dense fluid may comprise a mixture of a first dense phase fluid which chemically reacts with the contaminant to thereby facilitate removal of the contaminant, and a second dense phase fluid which serves as a carrier for the first dense phase fluid. For example, supercritical ozone or "superozone" is a highly reactive supercritical fluid/oxidant at temperatures greater than or equal to 270K and pressures greater than or equal to 70 atmospheres. The ozone may be generated external to the cleaning vessel, such as that shown in FIG. 6, mixed with a carrier gas, and introduced into the cleaning zone 46 through inlet 52. Known methods of forming ozone from oxygen by silent direct current discharge in air, water, or liquid oxygen and ultraviolet light exposure of air, as described, for example, in the publication entitled "UV/Ozone Cleaning for Organics Removal on Silicon Wafers," by L. Zaronte and R. Chiu, Paper No. 470-19, SPIE 1984 Microlithography Conference, March 1984, Santa Clara, California and in the publication entitled "Investigation into the Chemistry of the UV Ozone Purification Process," U.S. Department of Commerce, National Science Foundation, Washington D.C., January 1979 may be used. Optionally, the ozone may be generated in situ within a cleaning vessel of the type shown in FIG. 9 in which the guartz window 94 is replaced with a guartz light pipe array which pipes the ozone-producing producing ultraviolet light deep into the dense phase gas mixture. Oxygen, optionally blended with a carrier gas such as carbon dioxide, xenon, argon, krypton, or ammonia, is introduced into chamber 80 through gas solvent feed port 86. If no carrier gas is used in the input gas, excess oxygen serves as the carrier for the newly formed ozone. In practice, the substrate is placed in the chamber 80 and the system is operated as described for the system of FIG. 9. The mercury lamps 92 are activated to produce 185 nanometer radiation which strikes the oxygen gas ($O_2$) and converts it to ozone ($O_3$). After adjustment of the system pressure and temperature to form a dense phase gas, the superozone is transported to the substrate surface as a dense phase gas oxidant in the secondary dense fluid (i.e., dense phase carbon dioxide, argon, oxygen, or krypton).

Superozone has both gas-like and liquid-like chemical and physical properties, which produces increased permeation of this dense phase gas into porous structures or organic solids and films and more effective contaminant removal. In addition, superozone is both a polar solvent and an oxidant under supercritical conditions and consequently is able to dissolve into organic surface films or bulky compounds and oxidatively destroy them. Oxidation by-products and solubilized contaminants are carried away during depressurization operations previously described. The use of superozone has the added advantage that no hazardous by products or waste are generated. This embodiment of the present invention using superozone is particularly useful for deep sterilization of various materials, destroying unreacted compounds from elastomeric/resinous materials, in-situ destruction of organic hazardous wastes, precision cleaning of optical surfaces; preparation of surfaces for bonding processes; surface/subsurface etching of substrate surfaces, and reducing volatile organic compound levels in substrates, to produce materials and structured which meet NASA requirements for space applications.

Other materials which chemically react with the target contaminants may alternatively be used in this third embodiment of the present invention. For example, hydrogen peroxide can be used in place of ozone to provide an oxidant to react with the target contaminants. Moreover, other types or reactions besides oxidation can be effected in accordance with the present invention. For example, a material, such as ammonia, which can be photodissociated to form hydrogen species, can chemically reduce the target contaminants. A material, such as fluorine gas, which can be photodissociated to form fluorine, or other halogen radicals, can react with target contaminants.

Examples of practice of the present invention are as follows.

EXAMPLE 1

This example illustrates the use of one embodiment of the present invention to remove a variety of contaminants from a cotton tipped wooden applicator in preparation for using the applicator as a precision cleaning aid. The contaminants comprised wood oils, adhesive residues, particulate matter, cellulose, lignin, triglycerides, resins and gums with which the applicator had become contaminated during manufacture or through prior use in precision cleaning, or by their natural composition.

The dense phase gas used in practising the present process comprised 90 percent by volume carbon dioxide and 10 percent by volume nitrous oxide. The critical temperature for carbon dioxide is approximately 305K and the critical pressure is approximately 72 atmospheres. The critical temperature of nitrous oxide is 309K and the critical pressure is approximately 72 atmospheres.

The flowchart of FIG. 3 and the cleaning vessel of FIG. 6 were used as previously described herein. The contaminated substrate, namely the cotton-tipped wooden applicator, was placed on a rack and then in the cleaning vessel 12, and the vessel was purged- with inert gas. The temperature of the vessel was adjusted to approximately 320K. Next, the cleaning chamber was pressurized with the carbon dioxide nitrous oxide mixture to about 275 atmospheres. One cycle of phase shifting was carried out by incrementally varying (ramping) the temperature of the gas mixture from 320K to approximately 300K, which changed the gas solvent cohesive energy from approximately 12 MPa$^{\frac{1}{2}}$to 22 MPa$^{178}$ and then incrementally increasing the temperature from 300K to 320K, which changed the gas solvent cohesive energy content from approximately 22 MPa$^{\frac{1}{2}}$to 12 MPa$^{\frac{1}{2}}$. The gas mixture was allowed to contact the contaminated substrate after each temperature change (change in solvency) for 1 to 3 minutes prior to beginning batch or continuous cleaning operations. Phase shifting was carried out for approximately 30 minutes at a rate of 1 cycle every 5 minutes for continuous cleaning operations, and optionally for approximately 60 minutes at a rate of The cleaned substrate typically exhibited a weight loss of 2 to 4%, and solvent leachate tests showed less than 1 milligram of extractable residue per applicator. The cleaned substrate was packaged and sealed.

As previously discussed, this phase shifting process creates a "solvent spectrum" which overlaps the cohesive energy ranges for the contaminants and therefore provides a suitable solvent for each of the contaminants present in the cotton tipped wooden applicator.

The above described procedure utilizing carbon dioxide and nitrous oxide as the dense phase gas can be extended to other types of substrates containing a wide range of contaminants, including foam tipped plastic applicators, wiping cloths, cotton balls and gloves.

EXAMPLE 2

This example illustrates the use of the process of the present invention in order to clean a substrate to meet NASA outgassing requirements. The substrate comprised soldered pin connectors and the contaminants were solder flux residues, particulate matter, skin, oils, plasticizers, and potential outgassing contaminants.

The general procedure described in Example 1 was followed except that 100 percent carbon dioxide was used as the dense phase gas. The phase shift temperature range was approximately 310K to 298K at a pressure of approximately 200 atmospheres. Phase shifting was carried out for approximately 30 minutes at a rate of 1 cycle every 10 minutes. Following gas solvent cleaning, the vessel temperature was raised to 395K (250° F.) and a vacuum of 1 Torr was applied for 1 hour to remove residual gas. The cleaned substrate exhibited no signs of visible contamination in the pin sockets, and standard thermal vacuum outgassing tests in accordance with ASTM Standard E595 showed a total mass loss (TML) of less than 1.0% and a volatile condensible material (VCM) content of less than 0.1% for the entire assembly, which meets NASA outgassing requirements. The cleaned substrate was packaged and sealed as usual for subsequent operations.

EXAMPLE 3

The example illustrates the use of the process of the present invention to remove unreacted oils, colorants and fillers from fluorosilicone interfacial seals in order to improve insulation resistance (dielectric properties).

The general procedure describe]in Example 1 was followed except that 100 carbon dioxide was used as the dense phase gas. The phase shift temperature range was approximately 300K to 320K at a pressure of approximately 170 atmospheres. Phase shifting from the liquid state to the supercritical state was employed in order to first swell the bulk polymer (i.e., the fluorosilicone) in liquid $CO_2$ and then remove interstitial contaminants during phase shift operations. Phase shifting was carried out for approximately 30 minutes at a rate of 1 cycle every 10 minutes. Following cleaning operations, the material was thermal vacuum degassed and packaged. The cleaned substrates exhibited weight losses of 4% to 10%, and the- column to column

EXAMPLE 4

This example illustrates the u° e of the process of the present invention to remove surface contaminants, including solder flux residues, finger oils, and particulate matter, from ferrite cores prior to encapsulation in order to eliminate possible high voltage interfacial dielectric breakdown.

The general procedure described in Example 1 was followed except that the dense phase gas comprised 75 percent by volume dry carbon dioxide and 25 percent by volume anhydrous ammonia. The phase shift temperature range was approximately 375K to 298K at a pressure of about 240 atmospheres. Ammonia has a critical pressure of approximately 112 atmospheres and a critical temperature of approximately 405K. During the phase shifting operation, which was typically 1 cycle every 10 minutes for 45 minutes, the substrate was bathed in a two phase system (supercritical carbon dioxide/liquid ammonia) at temperatures above 305K and a binary solvent blend (liquid carbon dioxide-ammonia) at temperatures below 305K. Following cleaning operations, the substrate was packaged and sealed. The cleaned substrate exhibited visibly clean surfaces, and surface contamination tests showed less than 15 milligrams of ionic contaminants per square inch of surface area. The above described cleaning operation utilizing dense phase carbon dioxide and dense phase ammonia can be extended to other types of substrates containing a wide range of ionic/nonionic and organic/inorganic contaminants, including printed wiring boards, electronic connectors, spacecraft insulating blankets and ceramic daughter boards.

EXAMPLE 5

This example illustrates the use of the process of the present invention to remove machining oils, finger oils, and particulate matter from optical benches (active metal casting) to meet NASA outgassing requirements. The contaminants were removed from internal cavities as well as the external surfaces of the substrate.

The general procedure described in Example 1 was followed except that 100 percent carbon dioxide was used as the dense phase gas. The phase shift temperature range was 305K to 325K at about 340 atmospheres. Phase shifting was carried out at a rate of 1 cycle every 10 minutes. Following cleaning operations, the substrate was thermal vacuum degassed at 375K and 1 Torr (millimeter of mercury) for 30 minutes. The cleaned substrate was packaged and sealed, The cleaned substrate exhibited a TML of less than 1.0% and a VCM of less than 0.1%.

The above-described cleaning operation utilizing dense phase carbon dioxide can be extended to other types of substrates containing a wide range of contaminants including spacecraft fasteners, linear bearings, and heat pipes.

EXAMPLE 6

This example illustrates the use of the process of the present invention to remove non aqueous and semi-aqueous photoresist from printed wiring boards in order to prepare the boards for subseguent processing steps.

The general procedure described in Example 1 was followed except that the dense phase gas comprised xenon. Xenon has a critical pressure of approximately 57 atmospheres and a critical temperature of approximately 290K. Dense phase xenon was used at approximately 140 atmospheres and a phase shift temperature range of 285K to 300K was used to penetrate, swell, and separate the photoresist from the substrate. The phase shifting process was carried out as many times as necessary to effect adequate separation of the photoresist from the substrate. Optionally, other gases, for example ammonia, may be added to xenon to produce appropriate blends for various types of photoresists with varying cohesive energies and properties.

Thus, from the previous examples, it may be seen that the present invention provides an effective method for removing two or more contaminants from a given substrate in a single process. The types of contaminants removed in accordance with the present invention may have a wide variety of compositions and the substrates may vary widely in chemical composition and physical configuration.

The process of the present invention has wide application to the preparation of structures and materials for both terrestrial and space environments including gaskets, insulators, cables, metal castings, heat pipes, bearings and rivets. The particular cleaning fluid and phase shifting conditions utilized will vary depending upon the particular contaminants desired to be removed. The process is also especially well-suited for removing greases and oils from both internal and external surfaces of complex hardware.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A process for removing two or more contaminants from a chosen substrate comprising the steps of:

(a) placing said substrate containing said contaminants in a cleaning vessel;

(b) contacting said substrate containing said contaminants with a chosen dense phase gas at a pressure equal to or above the critical pressure of said dense phase gas; and (c) shifting the phase of said dense phase gas between the liquid state and the supercritical state by varying the temperature of said dense phase gas in a series of steps between a temperature above the critical temperature of said dense phase gas and a temperature below said critical temperature, maintaining said temperature at the completion of each said step for a period of time sufficient to remove one or more of said contaminants, and maintaining contact between said dense phase gas and said substrate containing said contaminants for said period of time at each said step wherein a solvent spectrum of said dense phase gas is provided to thereby remove said two or more contaminants from said substrate.

2. The process as set forth in claim 1 wherein said varying said temperature comprises starting at a first temperature below said critical temperature, increasing said temperature to a second temperature above said critical temperature, and then decreasing said temperature to said first temperature.

3. The process as set forth in claim 2 wherein said varying is performed more than film.

4. The process as set forth in claim 1 wherein said varying said temperature comprises starting at a first temperature above said critical temperature, decreasing said temperature to a second temperature below said critical temperature, and then increasing said temperature to said first temperature.

5. The process as set forth in claim 4 wherein said varying is performed more than one time.

6. The process as set forth in claim 1 wherein said temperature is varied above said critical temperature by about 5 to 100K.

7. The process as set forth in claim 6 wherein each said step comprises a change in temperature of about 5 to 10K.

8. The process as set forth in claim 6 wherein said predetermined period of time is within the range of about 5 to 30 minutes.

9. The process as set forth in claim 1 wherein said temperature is varied below said critical temperature by about 5 to 25K.

10. The process as set forth in claim 9 wherein each said step comprises a change in temperature of about 5 to 10K.

11. The process as set forth in claim 9 wherein said predetermined period of time is within the range of about 5 to 30 minutes.

12. The process as set forth in claim 1 wherein said dense phase gas is selected from the group consisting of carbon dioxide, nitrous oxide, ammonia, helium, krypton, argon, methane, ethane, propane, butane, pentane, hexane, ethylene, propylene, tetrafluoromethane, chlorodifluoromethane, sulfur hexafluoride, perfluoropropane, and mixtures thereof.

13. The process as set forth in claim 12 wherein said dense phase gas is selected from the group consisting of a mixture of carbon dioxide and nitrous oxide and a mixture of dry carbon dioxide and anhydrous ammonia.

14. The process as set forth in claim 1 wherein said dense phase gas comprises a mixture of a non-hydrogen bonding compound with a sufficient amount of a hydrogen-bonding compound to thereby provide hydrogen-bonding solvent properties in said mixture.

15. The process as set forth is claim 14 wherein said mixture comprises 75 to 90 percent liquid dry carbon dioxide and 25 to 10 percent liquid anhydrous ammonia.

16. The process as set forth in claim 15 wherein said contaminants are selected from the group consisting of an ionic substance and a polar substance.

17. The process as set forth in claim 1 wherein said substrate comprises a material selected from the group consisting of metal, organic compound, and inorganic compound.

18. The process as set forth in claim 17 wherein said substrate is selected from the group consisting of complex hardware, metal casting, printed wiring board, pin connector, fluorosilicone seal, ferrite core, and cotton tipped applicator.

19. The process as set forth in claim 1 wherein said contaminant is selected form the group consisting of oil, grease, lubricant, solder flux residue, photoresist, adhesive residue, plasticizer, unreacted monomer, inorganic particulates, and organic particulates.

20. The process as set forth in claim 1 wherein said dense phase gas containing said contaminants is continually removed from said cleaning vessel and replaced with additional dense phase gas in an amount sufficient to maintain the pressure in said cleaning vessel at or above said critical pressure.

21. A process as set forth in claim 1 wherein the temperature of said dense phase gas is controlled to provide a temperature gradient in which the temperature of said dense phase gas decreases from the surface of said substrate to the wall of said cleaning vessel.

22. The process as set forth in claim 1 further including after step "c", subjecting said substrate to thermal vacuum degassing to thereby remove residual dense phase gas from said substrate.

23. The process as set forth in claim 1 further including after step "c", displacing said dense phase gas with a chosen gas having a diffusion rate which is higher than the diffusion rate of said dense phase gas, and then depressurizing said cleaning vessel.

24. The process as set forth in claim 1 wherein said substrate is suspended in a liquid solvent to thereby enhance removal of said contaminants from said substrate.

25. The process as set forth in claim 1 wherein during step "c" said dense phase gas is exposed to ultraviolet radiation to thereby enhance removal of said contaminants from said substrate.

26. The process as set forth in claim 25 wherein said radiation has a wavelength within the range of 180 to 350 nanometers.

27. The process as set forth in claim 1 wherein during step "c" said dense phase gas and said substrate containing said contaminants are exposed to ultrasonic energy to thereby enhance removal of said contaminants from said substrate.

28. The process as set forth in claim 27 wherein said ultrasonic energy has a frequency within the range of about 20 to 80 kilohertz.

29. The process as set forth in claim 27 wherein said ultrasonic energy is shifted back and forth over the range between 20 and 80 kilohertz.

30. The process as set forth in claim 1 wherein during step "c" said dense phase gas and said substrate containing said contaminants are exposed to ultraviolet radiation and ultrasonic energy to thereby enhance removal of said contaminants from said substrate.

31. The process as set forth in claim 1 wherein said dense phase gas comprises a mixture of a first dense phase gas capable of chemically reacting with said contaminants to thereby enhance the removal of said contaminants, and a second dense phase gas as a carrier for said first dense phase gas.

32. The process as set forth in claim 31 wherein said first dense phase gas comprises an oxidant.

33. The process as set forth in claim 32 wherein said first dense phase gas comprises ozone.

34. The process as set forth in claim 33 wherein said second dense phase gas is selected from the group consisting of carbon dioxide, oxygen, argon, krypton, xenon, and ammonia.

35. The process as set forth in claim 33 wherein said ozone is generated in situ when said dense phase gas is contacted with said substrate.

36. The process as set forth in claim 1 wherein said shifting of said phase of said dense phase gas is accomplished under computer control.

* * * * *